US005842248A

United States Patent [19]

Van Grol et al.

[11] Patent Number: 5,842,248

[45] Date of Patent: Dec. 1, 1998

[54] TOOTHBRUSH WITH A CATCH BASIN AND DRAIN

[76] Inventors: Derrick K. Van Grol; Stephen G. Kosarko, both of 1261 Park Ave., Rochester, N.Y. 14610

[21] Appl. No.: 870,578

[22] Filed: May 21, 1997

Related U.S. Application Data

[60] Provisional application No. 60/019,348 Jun. 7, 1996.

[51] Int. Cl.[6] ..... A46B 9/04

[52] U.S. Cl. ..... 15/167.1; 15/248.1

[58] Field of Search ..... 15/143.1, 167.1, 15/205.2, 248.1

[56] References Cited

U.S. PATENT DOCUMENTS

| | | | |
|---|---|---|---|
| 851,550 | 4/1907 | Nevius | 15/167.1 |
| 878,486 | 2/1908 | Crowell . | |
| 939,202 | 11/1909 | Bessette | 15/248.1 |
| 1,501,020 | 7/1924 | Small . | |
| 2,154,209 | 4/1939 | Kohn | 15/167.1 |
| 2,394,640 | 2/1946 | Singer . | |
| 3,755,848 | 9/1973 | Mutrie . | |
| 3,968,950 | 7/1976 | Gallo . | |
| 4,621,387 | 11/1986 | Noser . | |

FOREIGN PATENT DOCUMENTS

| | | |
|---|---|---|
| 602732 | 3/1926 | France . |
| 717287 | 1/1932 | France . |
| 750214 | 8/1933 | France . |
| 1124772 | 10/1956 | France . |
| 2 380 754 | 9/1978 | France . |
| 145741 | 2/1903 | Germany . |
| 54004 | 12/1911 | Switzerland . |
| 183659 | 4/1936 | Switzerland . |

*Primary Examiner*—Terrence Till
*Attorney, Agent, or Firm*—Richard C. Litman

[57] ABSTRACT

A toothbrush with a funnel-like catch basin that is coaxial in design and is mounted on the toothbrush's handle for capturing and trafficking excess water, toothpaste, and saliva into a hollow bore in the handle. A cap may be inserted in the hollow bore to temporarily confine the waste therein.

11 Claims, 3 Drawing Sheets

TOOTHBRUSH WITH A CATCH BASIN AND DRAIN

CROSS-REFERENCE TO RELATED APPLICATION

This application claims the benefit of U.S. Provisional patent application Ser. No. 60/019,348, filed Jun. 7, 1996.

BACKGROUND OF THE INVENTION

1. Field of the Invention

The present invention relates to a toothbrush having a funnel-like catch basin mounted on its handle for capturing and trafficking excess water, toothpaste, and saliva into an internal passageway of the handle.

2. Description of Prior Art

Dentists recommend that a person brush his or her teeth after every meal for proper oral hygiene. For many people, following this recommendation would require that they brush their teeth while wearing their "good clothes" or even formal wear. When brushing with good clothing on, people risk getting excess water, toothpaste, and saliva on their clothes, especially the shirt cuffs. Many people even admit they sacrifice better oral hygiene than be bothered.

Various devices have been proposed in the prior art in an attempt to solve this problem, as exemplified by the following documents: U.S. Pat. No. 878,486, issued Feb. 4, 1908 to Lovill H. Crowell; U.S. Pat. No. 1,501,020, issued on Jul. 8, 1924 to Frank E. Small; U.S. Pat. No. 3,968,950, issued on Jul. 13, 1976 to George T. Gallo; French Patent Document Number 717,287, dated Jan. 6, 1932 to Kark Volk; French Patent Document Number 750,214, dated Apr. 7, 1933, by Edward-Joseph Ortion; French Patent Document No. 1,124,772, dated Oct. 17, 1956 to Sebastian Ritter; French Patent No. 2,380,754, dated Feb. 17, 1977 to Guy Guillem; and U.S. Pat. No. 2,394,640, issued on Feb. 12, 1946 to Henry Singer. Each of these patents shows a toothbrush having a removable shield attachment for protecting the user; none of these patents, however, disclose a toothbrush having a catch basin mounted on the handle for capturing and trafficking excess waste fluids into an internal passageway within the handle.

U.S. Pat. No. 3,755,848, issued on Sep. 4, 1973 to Charles B. Mutric, illustrates a toothbrush for arthritics, the toothbrush having a trough which is mounted at the top of an elongated handle. Mutric does not disclose a toothbrush having a catch basin for capturing and trafficking excess waste fluids into an internal passageway within a handle.

U.S. Pat. No. 4,621,387, issued on Nov. 11, 1986 to Anne M. Noser, shows a dental brushing aid having a shield disposed between the gripping portion of the handle and the terminal end portion. Noser does not disclose a toothbrush having a catch basin attachment mounted on its handle.

French Patent Document No. 602,732, dated Mar. 25, 1926 to Louis Demme et al., shows a paint brush having a cup with a hole that communicates with the core of the handle. The patent to Demme et. al. does not disclose a toothbrush having a catch basin fixedly attached on its handle for capturing and trafficking excess waste fluids into an internal passageway within a handle.

German Patent No. 145,741, dated Feb. 19, 1903 to Karl Fuhrmann and Emil Zimmermann, entitled Hohler Pinselhalter, shows a paint brush having a cup coaxial with the handle. The Pinselhalter device has no connection between the cup and the interior of the handle. Pinselhalter does not disclose a toothbrush having a catch basin for capturing and trafficking excess waste fluids into an internal passageway within a handle.

Swiss Patent Document No. 54,004, dated Dec. 6, 1911 to Albert Huber, shows a brush having a clip-on cup attached to the handle. Huber does not disclose a toothbrush having a catch basin with a wide mouth on its handle for capturing and trafficking excess waste fluids into a internal passageway within a handle.

Swiss Patent Document No. 183,659, dated Apr. 30, 1936, by Edwin Lorenz, shows various toothbrush drip cup attachments which drain into the lower handle cores in FIGS. 5 and 6. Lorenz does not show a toothbrush having a funnel-shaped catch basin fixedly attached on its handle for capturing and trafficking excess waste fluids into a internal passageway within a handle.

None of the above inventions and patents, taken either singly or in combination, is seen to describe the instant invention as claimed.

SUMMARY OF THE INVENTION

The present invention has been designed to accommodate today's busy career person who is continually on the look out for ways to increase the efficiency of their toiletry cycle time. With its unique catch basin design, the instant invention protects against wet sticky messes (and other toothpaste related accidents) by effectively "trafficking" excess waste fluids through an exit drain that funnels the waste material through an internal passageway within the toothbrush handle.

More specifically, the present invention relates to a funnel-like catch basin structural arrangement mounted on the handle of the toothbrush for capturing and trafficking excess water, toothpaste and saliva, and for protecting the user from exposure to such waste materials and fluids.

Accordingly, it is a principal object of the invention to provide a toothbrush having a funnel-shaped catch basin coaxially supported on its handle for capturing and trafficking excess waste fluids into an internal passageway within a handle.

It is another object of the invention to provide a toothbrush having a cup-like shield concentrically mounted on the toothbrush handle for the purpose of preventing excess waste fluids from flowing back on the gripping part of the handle and thereby passing this waste fluids to the hands or clothing of the user.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
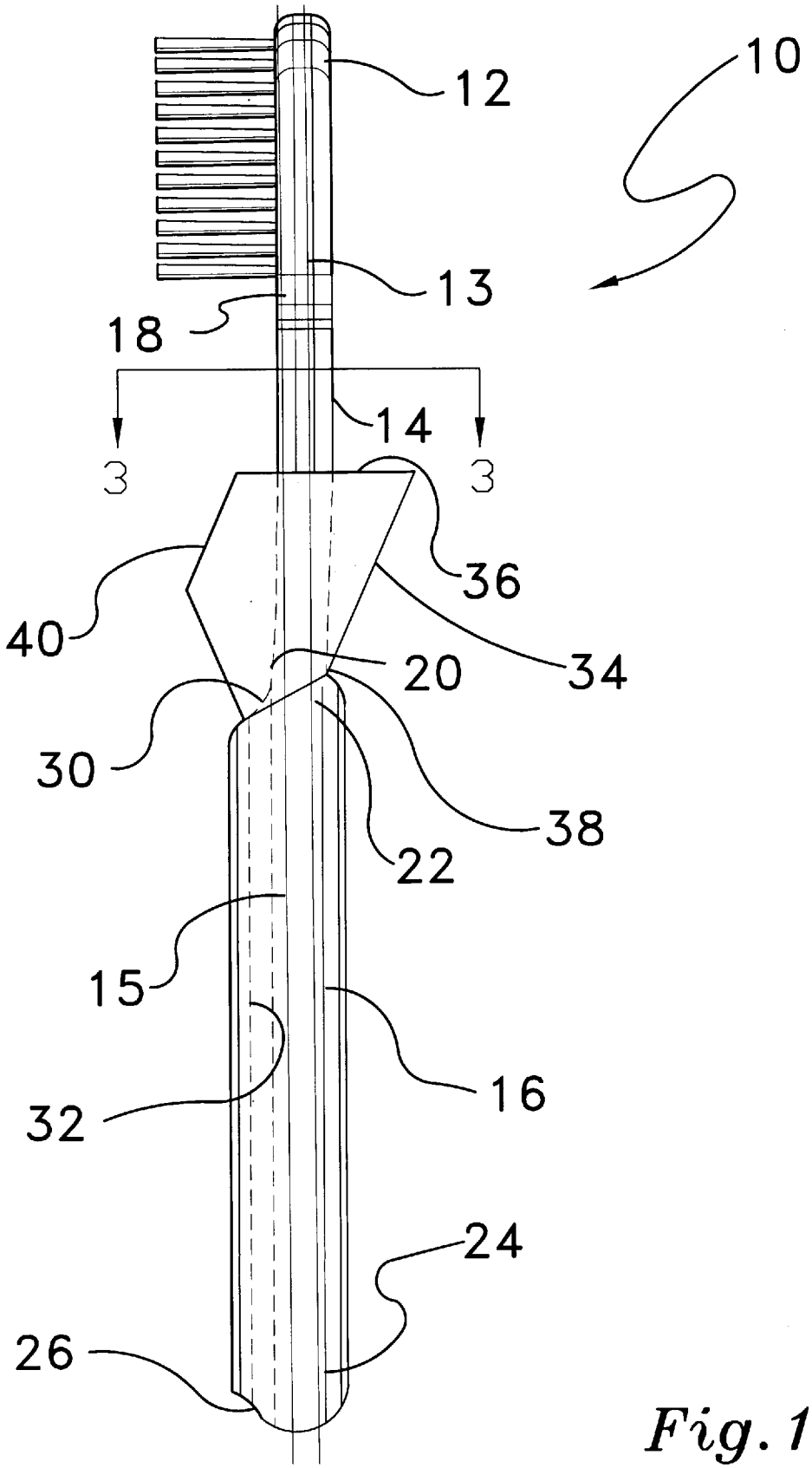
FIG. 1 is a side elevational view of the toothbrush of the present invention, showing internal details in phantom lines.

Referring to the drawings; there is illustrated a toothbrush 10 having a head 12 having bristles for brushing teeth. The toothbrush 10 includes an upper support shaft portion 14 and a lower handle portion 16. The support shaft 14 has a first end 18 and a second end 20 with a longitudinal axis defined therebetween. The head 12 is attached to the first end 18 of the support shaft 14.

Figure 3:
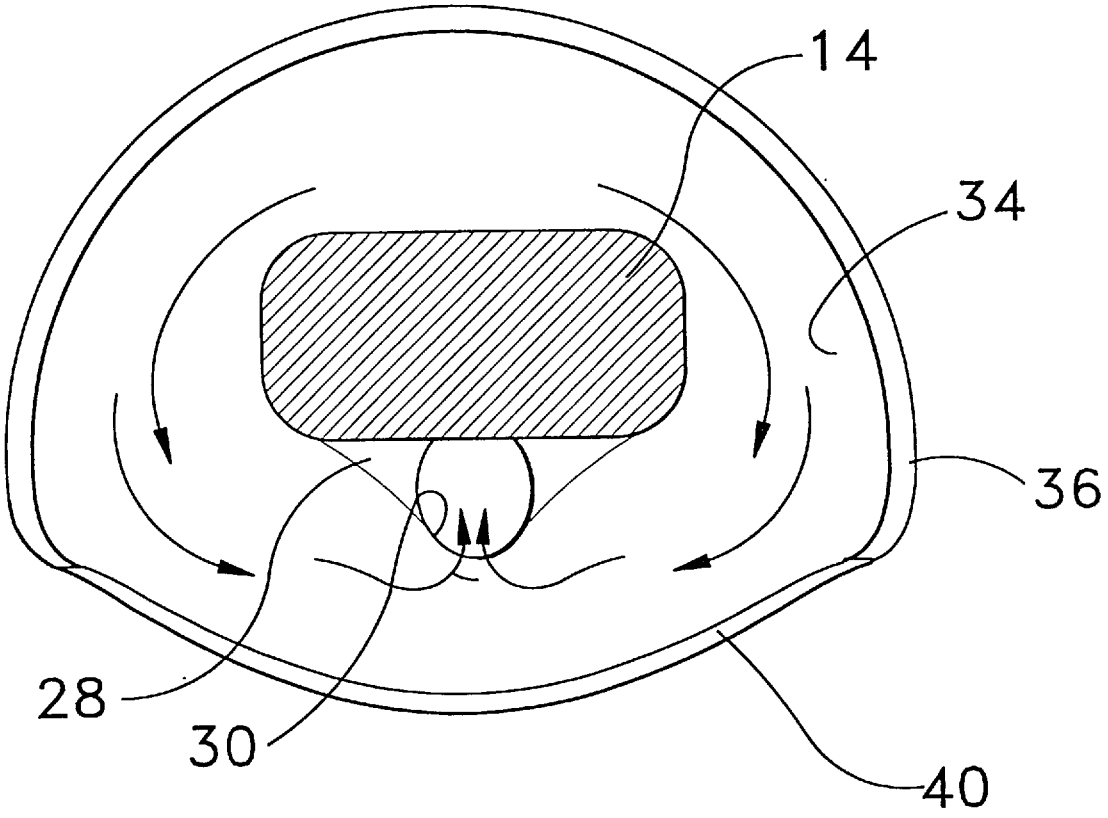
FIG. 3 is an enlarged scale, cross sectional view of the present invention, taken along line 3—3 of FIG. 1.

The handle 16 has a first end 22 and a second end 24 and a longitudinal axis defined therebetween. The second end 24 of the handle 20 has an exit hole 26 therein. The first end 22 of the handle 16 is attached to the second end 20 of the support shaft 14. The handle 16 has a larger cross sectional area than the support shaft 14. The longitudinal axis 13 of the support shaft 14 is parallel to the longitudinal axis 15 of the handle 16. The second end 20 of the support shaft 14 is attached to the first end 22 of the handle 16 such that the longitudinal axis of the support shaft 14 is offset relative to the longitudinal axis of the handle 16 so as to leave a shoulder 28 (see FIG. 3) at the first end 22 of the handle 16. The shoulder 28 has an drain hole 30 therein. The drain hole 30 communicates with a drain passageway 32 (see FIG. 1). The passageway 32 is internal to the handle 16, has a circular cross section, and is substantially straight with a longitudinal axis that is substantially parallel to the longitudinal axis of the handle 16.

Proximate the end 20 of the support shaft 14, is a surrounding wall which forms a funnel-like catch basin 34. The surrounding wall tapers from an open mouth 36 to a narrower bottom 38. The shoulder 28 in cooperation with the first end 22 of the handle 16, forms a closure for the bottom 38 of the catch basin 34. The mouth 36 of the catch basin 34, opens toward the head 12. A portion of the surrounding wall proximate the mouth 36, is cut back forming a recessed rim 40. The recessed rim 40 allows greater clearance for the movement of the head 12 during brushing.

The handle 16 and the support shaft 14 are preferably of one-piece construction. The shoulder 28 is sloped away from a plane perpendicular to the longitudinal axes of the support shaft 14 and the handle 16, thereby locating the drain hole 30 at the lowest point within the concave bowl of the catch basin 34.

Figure 2:
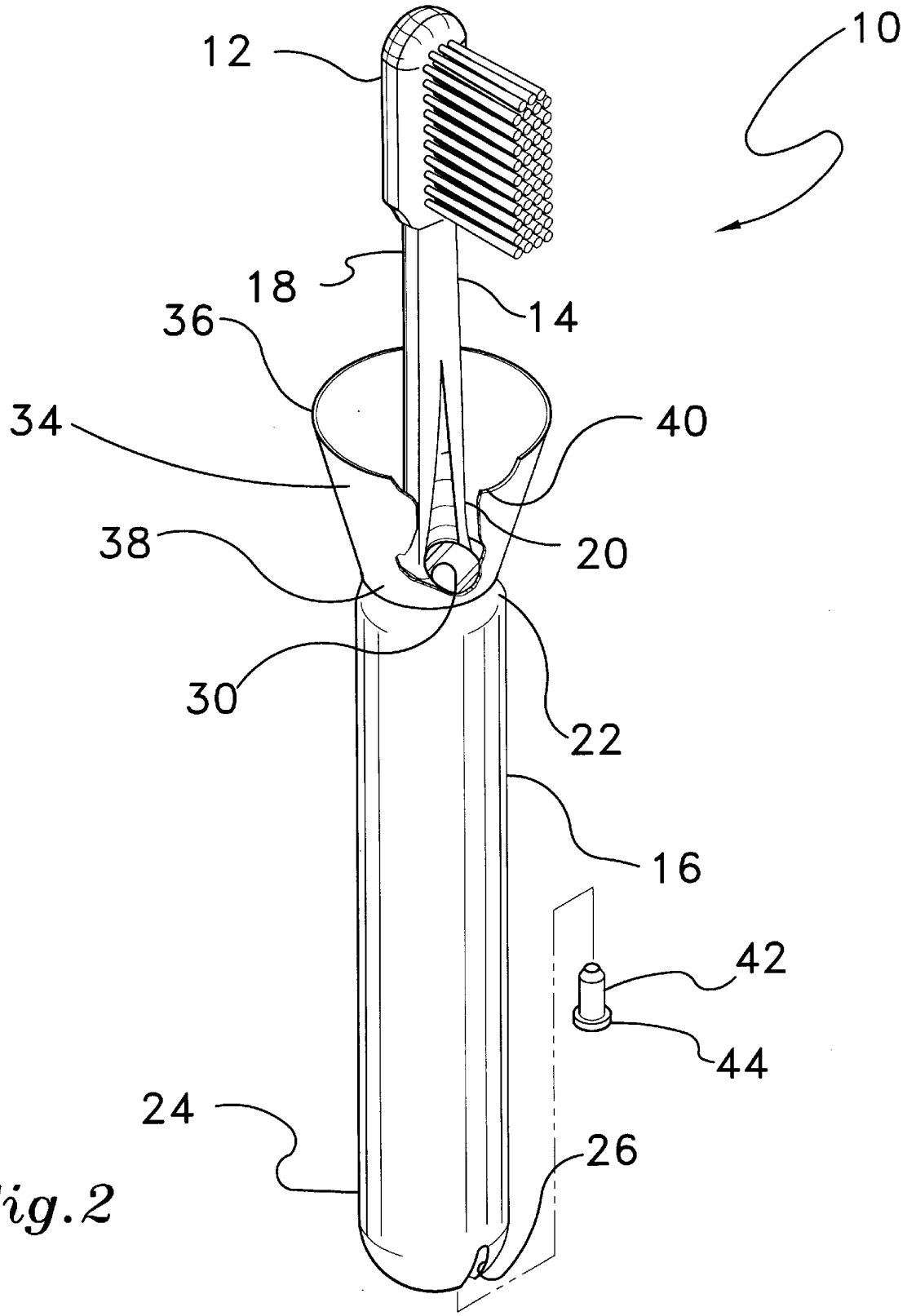
FIG. 2 is a perspective view of the present invention with the catch basin partially broken away to show the drain hole.

A cap 42 (see FIG. 2) is provided which is removably engageable with the exit hole 26. The cap 42 acts as a closure for the exit hole 26 when inserted in the exit hole. The cap 42 thus occludes the exit hole 26 and allows temporary storage of excess water, toothpaste, and saliva in the drain passageway 32 during brushing. The cap 42 has a projecting rim 44 to facilitate the grasping of the cap during insertion in and removal from the exit hole 26.

The catch basin 34 is located approximately three inches from the head 12 of the toothbrush 10. The bowl of the catch basin 34 captures and traffics excess water, toothpaste, and saliva that drains down the support shaft 14. Unlike a conventional toothbrush, this excess water, toothpaste, and saliva is prevented from running down the hand and forearm of the user and soiling his or her clothing. The catch basin 34 is preferably made of a soft rubber material so as to reduce the risk of injury to the user from inadvertent contact with the rim of the catch basin 34.

It is to be understood that the present invention is not limited to the embodiment described above, but encompasses any and all embodiments within the scope of the following claims.

We claim:

1. A toothbrush for capturing and trafficking excess fluids, said toothbrush comprising:

a support shaft having a first end and a second end, said support shaft having a longitudinal axis therebetween;

a head having bristles for brushing teeth, said head being attached to said first end of said support shaft;

a handle having a first end and a second end and a longitudinal axis therebetween, said first end of said handle attached to said second end of said support shaft such that said longitudinal axis of said support shaft is offset relative to said longitudinal axis of said handle so as to leave a shoulder at said first end of said handle, said shoulder defining a drain hole in communication with a drain passageway defined by said handle; and a catch basin including a surrounding wall having an open mouth facing toward said head and tapering to a narrower bottom, said shoulder in cooperation with said first end of said handle forming a floor of said bottom and thereby defining a concavity in communication with said drain hole;

whereby fluids flowing along said support shaft are captured by said catch basin and directed through said drain hole into said drain passageway.

2. The toothbrush according to claim 1, wherein said second end of said handle defines an exit hole therein in communication with said drain passageway.

3. The toothbrush according to claim 2, further including a cap member for removably engaging said exit hole, whereby said cap member closes said exit hole to temporarily trap excess fluids in said drain passageway.

4. The toothbrush according to claim 1, wherein said drain passageway is internal to said handle, has a circular cross section, and is substantially parallel to said longitudinal axis of said handle.

5. The toothbrush according to claim 1, wherein said handle and said support shaft are of one-piece construction.

6. The toothbrush according to claim 1, wherein said shoulder is angularly positioned relative to said longitudinal axis of said handle, thereby locating said drain hole at a lowest point within said concavity defined by said catch basin.

7. The toothbrush according to claim 1, wherein said surrounding wall proximate said mouth defines a cut-away portion to limit interference and contact of said surrounding wall with a user during movement of said head while brushing.

8. The toothbrush according to claim 1, wherein said handle has a larger cross sectional area than said support shaft.

9. The toothbrush according to claim 1, wherein said longitudinal axis of said support shaft is parallel to said longitudinal axis of said handle.

10. The toothbrush according to claim 1, wherein said catch basin is located approximately three inches from said head.

11. The toothbrush according to claim 1, further including a cap for removably engaging said drain hole.

* * * * *